US008005411B2

(12) United States Patent
Nakagawa et al.

(10) Patent No.: US 8,005,411 B2
(45) Date of Patent: Aug. 23, 2011

(54) IMAGE FORMING APPARATUS HAVING A TRANSFER UNIT INCLUDING AN ELASTIC MEMBER

(75) Inventors: Ken Nakagawa, Yokohama (JP); Masaru Shimura, Yokohama (JP); Kenji Kanari, Numazu (JP); Seiji Saito, Mishima (JP); Kazuhiro Doda, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/762,440

(22) Filed: Apr. 19, 2010

(65) Prior Publication Data

US 2010/0278567 A1 Nov. 4, 2010

(30) Foreign Application Priority Data

May 1, 2009 (JP) ..... 2009-111688

(51) Int. Cl.
*G03G 15/16* (2006.01)

(52) U.S. Cl. ..... 399/303; 399/302; 399/313

(58) Field of Classification Search ..... 399/302, 399/303, 305, 310, 313, 316, 66
See application file for complete search history.

(56) References Cited

U.S. PATENT DOCUMENTS

| | | | | |
|---|---|---|---|---|
| 5,081,501 | A * | 1/1992 | Waki et al. | 399/303 |
| 5,091,751 | A * | 2/1992 | Inoue et al. | 399/303 |
| 5,594,538 | A | 1/1997 | Takekoshi et al. | |
| 5,697,033 | A * | 12/1997 | Ichikawa et al. | 399/310 |
| 6,912,369 | B2 | 6/2005 | Saito et al. | |
| 6,999,692 | B2 | 2/2006 | Shimura et al. | |
| 7,783,238 | B2 * | 8/2010 | Oki et al. | 399/308 |
| 7,835,678 | B2 * | 11/2010 | Yasumaru et al. | 399/308 |
| 2002/0094217 | A1 * | 7/2002 | Miyamoto et al. | 399/303 X |
| 2006/0285888 | A1 * | 12/2006 | Stahuber | 399/310 |

FOREIGN PATENT DOCUMENTS

| | | | |
|---|---|---|---|
| JP | 2002-196595 | A | 7/2002 |
| JP | 03-388535 | B2 | 3/2003 |
| JP | 2003-330284 | A | 11/2003 |
| JP | 2009-048051 | A * | 3/2009 |
| JP | 2009-63742 | A | 3/2009 |

* cited by examiner

*Primary Examiner* — Sophia S Chen
(74) *Attorney, Agent, or Firm* — Fitzpatrick, Cella, Harper & Scinto

(57) ABSTRACT

An image forming apparatus includes an image bearing member for bearing a toner image; a rotatable intermediary transfer member; and a transfer unit, configured and positioned to form a transfer nip between the intermediary transfer member and the image bearing member, for transferring the toner image from the image bearing member onto a surface of the intermediary transfer member. The transfer unit includes a sheet member on which the intermediary transfer member is slidable, and includes an elastic member for urging the sheet member toward the intermediary transfer member at a position of the transfer nip. The sheet member is provided with a reinforcing portion, having a linear expansion coefficient different from that of the sheet member, in an area in which the elastic member urges the sheet member.

10 Claims, 9 Drawing Sheets

| | EMBODIMENT 1 | | | COMP. EMB. 1 | | |
|---|---|---|---|---|---|---|
| | 1st - 10th | 201st - 210th | 2991st - 3000th | 1st - 10th | 201st - 210th | 2991st - 3000th |
| 1st | ○ | ○ | ○ | ○ | × | × |
| 2nd | ○ | ○ | ○ | ○ | × | × |
| 3rd | ○ | ○ | ○ | ○ | × | × |
| 4th | ○ | ○ | ○ | × | × | × |
| 5th | ○ | ○ | ○ | × | × | × |

Fig. 5

IMAGE FORMING APPARATUS HAVING A TRANSFER UNIT INCLUDING AN ELASTIC MEMBER

FIELD OF THE INVENTION AND RELATED ART

The present invention relates to an image forming apparatus, utilizing an electrophotographic recording method, such as a laser printer or a copying machine.

The image forming apparatus, utilizing the electrophotographic recording method, such as the copying machine or the printer includes a transfer unit to which a transfer voltage is to be applied by a transfer voltage applying unit such as a high voltage source circuit. This transfer unit provides a transfer (electric) charge of an opposite polarity to a charge polarity of a toner image to the toner image borne on, e.g., a photosensitive drum through a belt member such as a transfer conveyer belt for carrying a transfer material or an intermediary transfer belt. As a result, the toner image on the photosensitive drum is electrostatically transferred onto the transfer material or a surface of the intermediary transfer belt.

As the transfer unit, a sheet-like transfer device using a sheet such as a thin plate-like member or the like is employed. U.S. Pat. No. 5,594,538 discloses the sheet-like transfer device having a plurality of layers including a layer on which the belt member is slidable, an electrode layer for providing the transfer charge, and an elastic layer for creating a contact force. Japanese Patent No. 3388535 discloses the sheet-like transfer device in which a flexible sheet is deformed in a curved surface shape and an elastic force of a supporting means for the flexible sheet is changed so that an urging force of the sheet-like transfer device toward the transfer conveyer belt with respect to a movement direction of the transfer material is successively changed. By this sheet-like transfer device, a device to decrease a frictional resistance between the sheet-like transfer device and the transfer conveyer belt has been made.

In the conventional sheet-like transfer devices the sheet member is sheet member constituted by multiple layers and an urging force against a toner image receiving member is obtained by a deflection force of an elastic layer as one of the multiple layers. For example, the sheet-like transfer device includes four layers consisting of the electrode layer, an electroconductive layer, a contact layer, and the elastic layer and these layers are bonded to and supported by each other. The sheet member prepared by laminating these layers different in physical properties is different in linear expansion coefficient among the respective layer depending on a change of an ambient temperature, thus being liable to be warped. When the sheet member causes the warping, contact between the sheet-like transfer device and the toner image receiving member becomes unstable and in this state, the toner image cannot be sufficiently transferred onto the toner image receiving member to result in image defect in some cases.

Further, in the sheet like transfer device, the sheet member slides on the toner image receiving member contacting the sheet member and therefore the sheet member is deformed in some cases by frictional heat generated due to the sliding. A phenomenon that crinkles are generated on the sheet member is called a waving phenomenon. When the crinkles generated on the sheet member are minute crinkles, the crinkles do not cause the image defect.

However, when non-uniformity occurs in contact force with respect to the toner image receiving member, a temperature difference of the frictional heat is generated to cause a partial thermal expansion of the sheet member, so that the crinkles of the sheet member are encouraged. That is, the crinkles are increased by repetitive use of the sheet-like transfer device, so that a transfer property of the sheet member with respect to a longitudinal direction of the sheet member is made non-uniform in some cases.

SUMMARY OF THE INVENTION

The present invention has been accomplished in view of the above-described circumferences.

A principal object of the present invention is to provide an image forming apparatus capable of maintaining a good transfer property by suppressing an occurrence of crinkles on a sheet member of a sheet like transfer device.

According to an aspect of the present invention, there is provided an image forming apparatus comprising:

an image bearing member for bearing a toner image;

a rotatable intermediary transfer member; and a transfer unit, configured and positioned to form a transfer nip between the intermediary transfer member and the image bearing member, for transferring the toner image from the image bearing member onto a surface of the intermediary transfer member, wherein the transfer unit comprises a sheet member on which the intermediary transfer member is slidable, and comprises an elastic member for urging the sheet member toward the intermediary transfer member at a position of the transfer nip, and wherein the sheet member is provided with a reinforcing portion, having a linear expansion coefficient different from that of the sheet member, in an area in which the elastic member urges the sheet member.

According to another aspect of the present invention, there is provided an image forming apparatus comprising:

an image bearing member for bearing a toner image;

a rotatable transfer material carrying member for carrying and conveying a transfer material; and a transfer unit, configured and positioned to form a transfer nip between the transfer material carrying member and the image bearing member, for transferring the toner image from the image bearing member onto a surface of the transfer material conveyed by the transfer material carrying member, wherein the transfer unit comprises a sheet member on which the transfer material carrying member is slidable, and comprises an elastic member for urging the sheet member toward the transfer material carrying member at a position of the transfer nip, and wherein the sheet member is provided with a reinforcing portion, having a linear expansion coefficient different from that of the sheet member, in an area in which the elastic member urges the sheet member.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 5 is a table for illustrating an evaluation result of Embodiment 1 and Comparative Embodiment 1.

DESCRIPTION OF THE PREFERRED EMBODIMENTS

Embodiment 1

Figure 1:
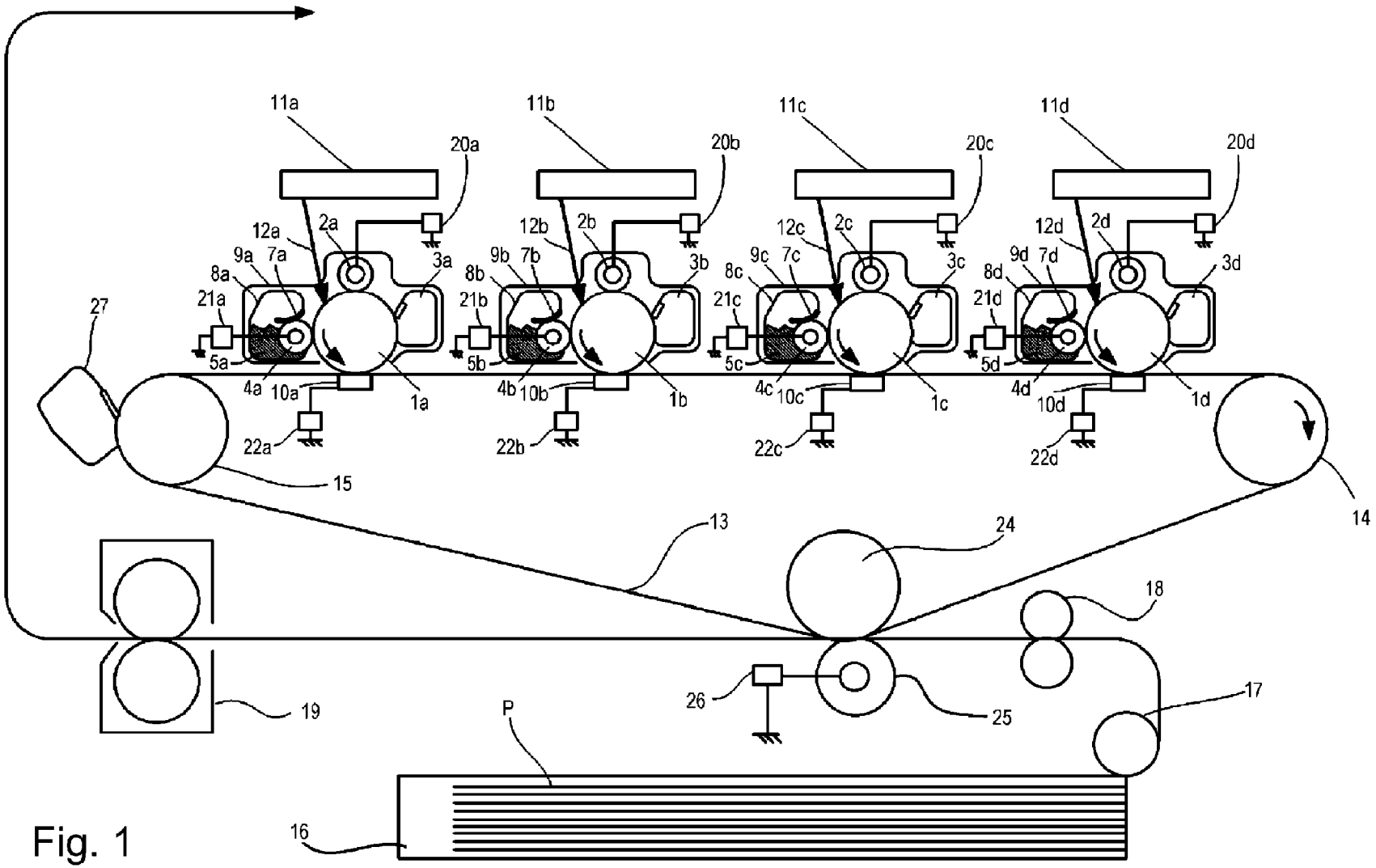
FIG. 1 is a schematic view for illustrating an image forming apparatus according to Embodiment 1 of the present invention.

Hereinbelow, an embodiment of the present invention will be described in detail based on the drawings. FIG. 1 is a schematic view showing a general structure of the image forming apparatus.

In the image forming apparatus shown in FIG. 1, from an upstream side of a rotatable intermediary transfer member 13 with respect to a rotational movement direction of the intermediary transfer member 13, a first image forming station for forming an image of yellow (Y), a second image forming station for forming an image of magenta (M), a third image forming station for forming an image of cyan (C), and a fourth image forming station for forming an image of black (K) are disposed. Here, the intermediary transfer member 13 is an intermediary transfer belt 13 to be stretched around a plurality of stretching members.

To the first to fourth image forming stations, process cartridges 9 (9*a* to 9*d*) are detachably provided individually. Incidentally, the process cartridges 9*b* to 9*d* have the same constitution as that of the process cartridge 9*a* and therefore the process cartridge 9*a* will be described representatively, so that other process cartridges 9*b* to 9*d* will be omitted from description. The process cartridge 9*a* as the first image forming station includes an organic photoconductor (OPC) photosensitive drum 1*a* as an image bearing member, a charging roller 2*a* as a charging unit, a cleaning unit 3*a* for removing untransferred toner on the photosensitive drum 1*a*, and a developing unit 8*a*. The developing unit 8*a* includes a developing sleeve 4*a*, a non-magnetic one component developer 5*a*, and a developer application blade 7*a*.

Exposure units 11*a* to 11*d* are constituted by a scanner unit for scanning the photosensitive drums 1*a* to 1*d* with laser light through a polygonal mirror and irradiate the surfaces of the photosensitive drums 1*a* to 1*d* with scanning beams 12*a* to 12*d* modulated on the basis of an image signal.

When an image forming operation is started, the photosensitive drums 1*a* to 1*d*, the intermediary transfer belt 13, and the like start their rotations in directions indicated by arrows at predetermined process speeds. The photosensitive drums 1*a* to 1*d* are uniformly charged to a negative polarity by the charging rollers 2*a* to 2*d* connected to charging voltage sources 20*a* to 20*d*. Then, on the photosensitive drums 1*a* to 1*d*, electrostatic latent images are formed in accordance with image information by the scanning beams 12*a* to 12*d* from the exposure units 11*a* to 11*d*. Toners 5*a* to 5*d* in the developing units 8*a* to 8*d* are charged to the negative polarity by the developer application blades 7*a* to 7*d* and are applied onto the developing sleeves 4*a* to 4*d*.

Then, to the developing sleeves 4*a* to 4*d*, a bias is supplied from developing voltage sources 21*a* to 21*d* and when the photosensitive drums 1*a* to 1*d* are rotated and the electrostatic latent images formed on the photosensitive drums 1*a* to 1*d* reach the developing sleeves 4*a* to 4*d*, the electrostatic latent images are visualized by the negative-polarity toners. As a result, on the photosensitive drums 1*a* to 1*d*, toner images (developer images) of yellow (Y) (first color), magenta (M), cyan (C), and black (K) are successively formed.

The intermediary transfer belt 13 is disposed so as to contact all the four photosensitive drums 1*a* to 1*d*. Here, the intermediary transfer belt 13 is a toner image receiving member onto which the toner images are to be transferred from the photosensitive drums 1*a* to 1*d*. The intermediary transfer belt 13 is stretched around three rollers, as a stretching member, consisting of a secondary transfer opposite roller 24, a driving roller 14, and a tension roller 15, and is rotated in a direction indicated by an arrow while being held under a proper tension. That is, the intermediary transfer belt 13 is configured to be rotated in the same direction as and at the substantially equal speed as those of the photosensitive drums 1*a* to 1*d* by driving the driving roller 14.

Transfer units 10*a* to 10*d* for performing primary transfer of the toner images are sheet-like transfer devices 10*a* to 10*d* including a sheet member. These sheet-like transfer devices 10*a* to 10*d* are individually disposed so as to sandwich the intermediary transfer belt 13 between the photosensitive drums 1*a* to 1*d* and themselves. Further, to the sheet-like transfer devices 10*a* to 10*d*, primary transfer power sources 22*a* to 22*d* as a voltage supply circuit are connected. To a secondary transfer roller 25, a secondary transfer power source 26 is connected.

While delaying a writing signal for each color from an unshown controller with certain timing depending on a distance between primary transfer positions for respective colors, the electrostatic latent images are formed on the respective photosensitive drums 1*a* to 1*d* by the exposure to light and then to the sheet-like transfer devices 10*a* to 10*d*, a voltage of an opposite polarity to the charge polarity of the toner images is applied from the primary transfer power sources 22*a* to 22*d*. As a result, the toner images are transferred from the respective photosensitive drums 1*a* to 1*d* onto the intermediary transfer belt 13, so that multiplex images are formed on the intermediary transfer belt 13. That is, the sheet-like transfer devices 10*a* to 10*d* are configured and positioned to form transfer nips, respectively, between the intermediary transfer belt 13 and the opposing photosensitive drums 1*a* to 1*d*. In each of the transfer nips, the toner image on the photosensitive drum is transferred onto the surface of the intermediary transfer belt 13.

A transfer material P stacked in a transfer material cassette 16 is picked up by a sheet feeding roller 17 with predetermined timing and is fed to registration rollers 18 by unshown feeding rollers. The transfer material P is conveyed to a secondary transfer nip between the intermediary transfer belt 13 and the secondary transfer roller 25 by the registration rollers 18 in synchronism with the toner images transferred on the intermediary transfer belt 13.

Then, to the secondary transfer roller 25, a voltage of an opposite polarity to the toner charge polarity is applied from the secondary transfer power source 26. Thus, onto the transfer material P, the multiplex four color toner images carried on the intermediary transfer belt 13 are collectively secondary-transferred.

Incidentally, in this embodiment, as the secondary transfer roller 25, a nickel-plated steel rod having a diameter of 8 mm coated with a 5 mm-thick foamed sponge member of NBR adjusted to have a resistance of $10^8$ ohm so as to have an outer diameter of 18 mm was used. Further, the secondary transfer roller 25 was brought into contact with the intermediary transfer belt 13 at a linear pressure of about 5-15 g/cm and was disposed so as to be rotated in the same direction as the movement direction of the intermediary transfer belt 13 at the speed substantially equal to that of the intermediary transfer belt 13.

On the other hand, after the secondary transfer is completed, the untransferred toner remaining on the intermediary transfer belt 13 and paper powder transferred from the transfer material P onto the intermediary transfer belt 13 are removed and collected from the surface of the intermediary transfer belt 13 by a belt cleaning means 27 disposed in contact with the intermediary transfer belt 13. Further, as the belt cleaning means 27, a cleaning blade formed of an urethane rubber or the like and having elasticity was used.

The transfer material P after the completion of the secondary transfer is conveyed into a fixing means 19 and is subjected to fixation of the toner image, thus being discharged to the outside of the image forming apparatus as an image-formed product (print or copy). Incidentally, the intermediary transfer belt 13 is constituted by a 100 μm-thick sheet of PVDF having a volume resistivity of $10^{10}$ ohm.cm.

As the driving roller 14 as the stretching member, a 25 mm-diameter roller prepared by coating a core metal of Al with a 1.0 mm-thick EPDM rubber in which carbon black is dispersed as an electroconductive agent to provide a resistance of $10^4$ ohm is used. The tension roller 15 as the stretching member is formed with a metal rod of Al having a diameter of 25 mm and is urged by unshown springs as its both end portions that the tension acts on the intermediary transfer belt 13. The urging force is 19.6 N on one side, i.e., 39.2 N in total on the both sides. As the secondary transfer roller 24 as the stretching member, a 25 mm-diameter roller prepared by coating the core metal of Al with a 1.5 mm-thick EPDM rubber in which the carbon black is dispersed as the electroconductive agent to provide the resistance of $10^4$ ohm is used.

Next, the sheet-like transfer devices 10*a* to 10*d* as the transfer unit will be described. Incidentally, the sheet-like transfer devices 10*b* to 10*d* have the same constitution as that of the sheet-like transfer device 10*a* and therefore the sheet-like transfer device 10*a* will be described representatively, so that other sheet-like transfer devices 10*b* to 10*d* will be omitted from description.

Figure 2:
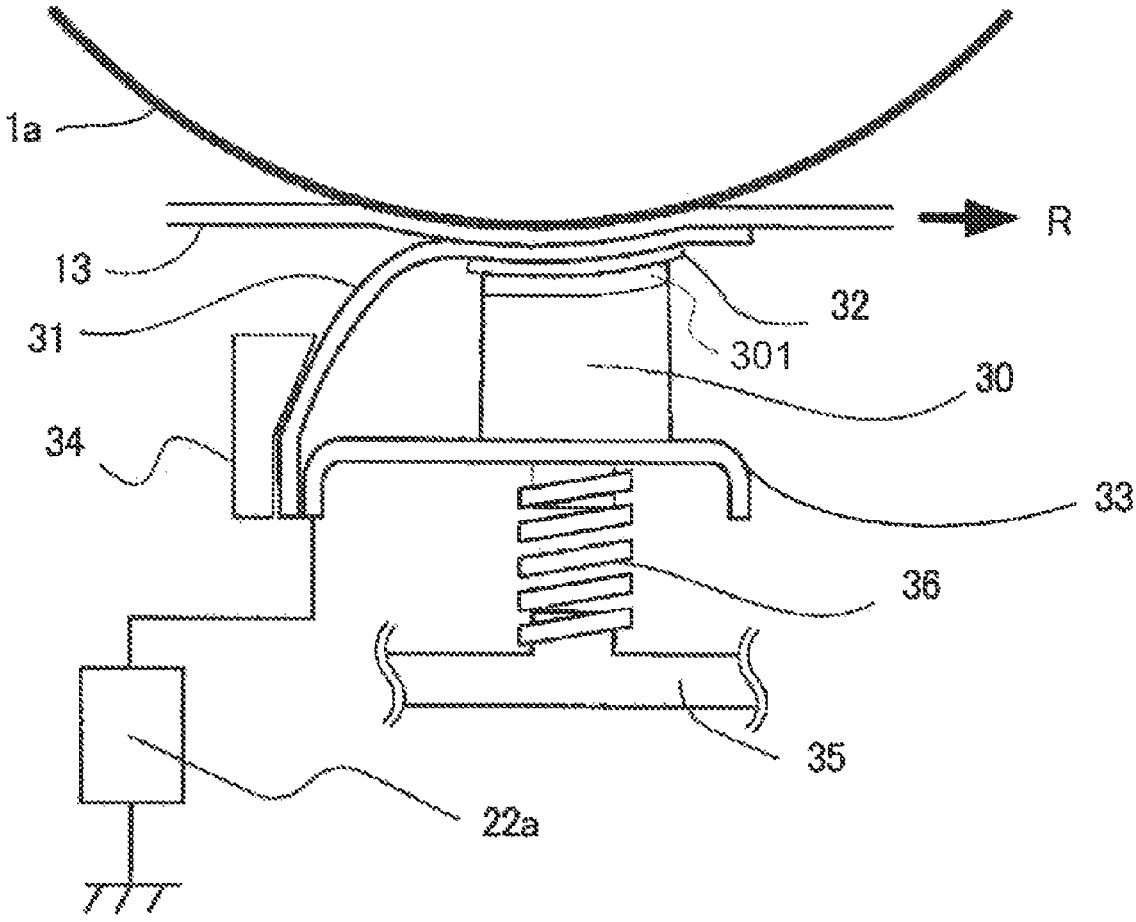
FIG. 2 is a schematic view for illustrating a sheet-like transfer device shown in FIG. 1.

FIG. 2 is a schematic view showing the sheet-like transfer device 10*a* for the first image forming station. The intermediary transfer belt 13 contacts the rotatable photosensitive drum 1*a* and is moved in a direction indicated by an arrow R. The sheet-like transfer device 10*a* includes at least a sheet member 31 and an elastic member 30 (cushioning member) for urging the sheet member 30 toward the intermediary transfer belt 13. Further, the sheet-like transfer device 10*a* includes a presser member 34 and a supporting member provided with a base 33. The presser member 34 fixes one end of the sheet member 31, and the base 33 supports the cushioning member 30.

The sheet-like transfer device 10*a* forms the transfer nip between the intermediary transfer belt 13 and the photosensitive drum 1*a*. Further, the cushioning member 30 urges the sheet member 31 against the intermediary transfer belt 13 in the transfer nip.

Further, the sheet member 31 is provided with a reinforcing sheet 32 as a reinforcing portion in an area in which the cushioning member 30 urges the sheet member 31 against the intermediary transfer belt 13.

The cushioning member 30 is fixed on the base 33 and these members are integrally movable in a vertical direction in FIG. 2. Between the base 33 and a transfer (member) frame 35 fixed to the apparatus main assembly, a spring 36 as an urging member is interposed and creates the urging force toward the photosensitive drum 1*a*. In a state in which the urging force is exerted, the cushioning member 30 itself is deformed to uniformize the urging force toward the reinforcing sheet 32 with the contact surface and at the same time, the sheet member 31 and the intermediary transfer belt 13 follow the shape of the photosensitive drum 1*a*. As a result, a contact area between the sheet member 31 and the intermediary transfer belt 13 is extended, so that the transfer nip area between the intermediary transfer belt 13 and the photosensitive drum 1*a*, i.e., an area in which both of pressure and electric field act on the toner image is extended.

As shown in FIG. 2, the reinforcing sheet 32 is provided in an area broader than the area of an upper surface of the cushioning member 30 (an opposing surface of the cushioning member 30 with respect to the sheet member 31) so as to include the contact portion between the reinforcing sheet 32 and the cushioning member 30. To the base 33, the primary transfer power source 22*a* as a voltage application circuit is connected and a transfer voltage is supplied. Incidentally, the primary transfer power source 22*a* may also be constituted so as to directly apply the transfer voltage to the sheet member 31 or constituted so as to apply the transfer voltage to the cushioning member 30 when the cushioning member 30 is electroconductive.

The sheet member 31 has a linear expansion coefficient of $18\times10^{-5}$/° C. (ASTM test method D696) and is formed of ultrahigh molecular weight polyethylene.

As the electric resistance of the sheet member 31, a resistance value measured by attaching a 1 cm-square-electrode to each of the front and rear surfaces of the sheet member 31 and applying a voltage of 50 V between the electrodes on the front and rear surface is used. The resistance value may preferably be $1\times10^{13}$ ohm or less, more preferably be $1\times10^1$ ohm to $1\times10^8$ ohm. In this embodiment, the sheet member 31 having the resistance value of $1\times10^2$ ohm was used. When the electric resistance exceeds $1\times10^{13}$ ohm and is excessively high, a sufficient voltage is not applied to the intermediary transfer belt 13, so that an amount of transfer of the toner image onto the intermediary transfer belt 13 is undesirably lowered.

As a sheet material used for the sheet member 31, when the electroconductive material such as carbon black is contained so as to provide the above-descried electric resistance, a material having flexibility when formed in a sheet such as polycarbonate (PC), PVDF, PET, polyimide (PI), or polyamide (PA) as a base resin can suitably be used.

The sheet member 31 slides on the intermediary transfer belt 13, so that its frictional coefficient largely affects a driving torque of the intermediary transfer belt 13. In this embodiment, in order to decrease the driving torque, the above-described ultrahigh molecular weight polyethylene which is a material having a small friction coefficient and an excellent anti-wearing property is used.

As the material for the sheet member 31, apart from the ultrahigh molecular weight polyethylene, fluorine-containing resin such as PTFE, PFA or FEP can be more suitably used.

When a metal material is made thin, the resultant metal material has flexibility but the belt member is generally formed of a polymeric resin material. Therefore, in the case where the sheet member 31 is formed of the metal material, abrasion or measuring of the belt is caused to occur and the contact between the sheet member 31 and the intermediary transfer belt 13 is clogged with abraded powder of the belt by long-term use of the image forming apparatus, so that a streak-like image defect is liable to occur. For this reason, the sheet member 31 may preferably be a resin sheet.

In this embodiment, the sheet member 31 having a size of 20 mm in width, 230 mm in length and 100 μm in thickness was used. The thickness of the sheet member 31 may appropriately be 10 μm to 500 μm and may preferably have rigidity close to that of the intermediary transfer belt 13 so as to follow the intermediary transfer belt 13 to some extent by the urging force of the cushioning member 30 and may move preferably have the rigidity lower than that of the intermediary transfer belt 13.

However, the sheet member 31 receives the frictional force by the movement of the intermediary transfer belt 13 and thus receives continuously a tensile force by which the sheet member 31 is pulled toward the downstream side, so that the sheet member 31 which has excessively low rigidity and thus is plastically deformed by the tensile force causes the image defect and undesirably changes the nip area. The sheet member 31 having rubber elasticity causes a similar inconvenience due to elongation to undesirably change the nip area.

The reinforcing sheet 32 is bonded to the sheet member 31 in order to suppress an occurrence of crinkles is the transfer nip of the sheet member 31. As the sheet material used for the reinforcing sheet 32, a material having flexibility such as polycarbonate (PC), PET, polyimide (PI), polyamide (PA), or a metal material when formed in a sheet, and having the linear expansion coefficient lower than that of the sheet member 31 can be suitably used. Further, depending on a value of the linear expansion coefficient of the sheet member 31, the material having the linear expansion coefficient larger than that of the sheet member 31 can also be used.

The reinforcing sheet 32 may be either of electrically insulative and electrically conductive with respect to electrical conductivity. However, in the case of a constitution in which the primary transfer power source 22*a* applies the transfer voltage to the cushioning member 30, the reinforcing sheet 32 may desirably be electroconductive in order that a current is efficiently passed through the sheet member 31 by the medium of the reinforcing sheet 32. In this embodiment, a PET tape prepared by applying an adhesive material onto one surface of an electrically insulative PET sheet having a width of 7 mm, a length of 230 mm and a thickness of 40 μm is used and is bonded to the sheet member 31 at the adhesive material surface.

The PET sheet used had the linear expansion coefficient of $6.5\times10^{-5}/°$ C. (ASTM test method D696). The PET sheet is bonded to the sheet member 31 so that the PET sheet and the adhesive do not protrude from the sheet member 31, and then is cut at both end to have a length of 230 mm.

By providing the reinforcing sheet 32, the occurrence of crinkles on the sheet member 31 when the sheet member 31 slides on the intermediary transfer belt 31 to cause a change in temperature is suppressed. Specifically, the size of crinkles can be described and the sheet member 31 can be curved with respect to a longitudinal direction of the sheet member 31 (a direction perpendicular to a rotational direction of the intermediary transfer belt). The reason for this will be described later.

As the cushioning member 30, a foamed sponge-like elastic member of urethane formed in a substantially rectangular parallelopiped shape having a thickness of 5 mm, a width of 5 mm, and a length of 225 mm is used. A hardness of the cushioning member 30 is 30 degrees measured by an ASKER C hardness meter under a load of 500 gf.

As the cushioning member 30, a solid rubber material such as epichlorohydrin rubber, NBR or EPDM may also be used so long as the cushioning member 30 itself is elastically deformed. The solid material deforms, when subjected to pressure application, so as to escape to a portion to which the pressure is not applied and thus is not largely changed in volume. For this reason, when the urging force is changed, the nip area is changed. On the other hand, when a material, which has inner pores and is decreased in apparent volume when it receives a compressive force, such as the sponge-like foam, a foam member, or a nonwoven fabric is used, a contact area between the reinforcing sheet 32 and the cushioning member 30 is not so changed even in the case where the urging force is changed due to manufacturing variation of respective parts, so that an area of the transfer nip area is stabilized and consequently a transfer performance is stabilized. Therefore, this material is more preferable than the solid material. The sponge may preferably be formed by injecting a material therefore into a metal mold. At a surface (interface) where the cushioning member 30 contacts the sheet member 31, a skin layer 301 with less pores is formed. It is preferable that the sponge material cut so that the surface where the cushioning member 30 contacts the sheet member 31 constitutes the skin layer 301 is disposed. The urging surface is constituted by the skin layer 301 which has a material density higher than that of an inner sponge layer and is less liable to be deformed than the sponge portion, so that it is possible to further suppress a fluctuation in area of the transfer nip during repetitive compression without impairing a cushioning performance.

The base 33 may preferably be formed of a material having rigidity sufficiently higher than that of the cushioning member 30 in order to uniformly transmit a local urging force by the spring 36 as an urging member. As the material, it is possible to suitably use metal, a molded resin material, and the like having a thickness of 0.3 mm or more. Further, the base 33 is required to have the electroconductivity in order to supply the transfer voltage, so that a 1 mm-thick metal plate of iron bent in a U-shape was used.

The spring 36 has a spring force of 0.061 N (0.6 kgf) and the unit has its own weight, so that a force of 0.041 N (0.4 kgf) is exerted from the cushioning member 30 to the sheet member 31. When the spring force is excessively low, the transfer property is impaired at a portion, where the pressure is low, due to longitudinal pressure non-uniformity at the time when the cushioning member 30 urges the sheet member 31, so that inconvenience of a decrease in image density undesirably occurs. Further, when the spring force is excessively large, a torque for driving the intermediary transfer belt 13 is undesirably increased. The contact force between the cushioning member 30 and the sheet member 31 may preferably be in the range from about 0.005 N to about 0.5 N in the sheet-like transfer device for A4-sized transfer material. As the contact force per unit length may preferably be in the range from about $2\times10^{-4}$ N/cm to about 0.023 N/cm.

The presser member 34 is provided in order that the sheet member 31 is firmly fixed by being put between the presser member 34 and the base 33 so as not to fall off even when a large frictional force is exerted on the cushioning member 31. For this reason, the presser member 34 may preferably be formed of a high-rigidity material in order to contact the substantially entire longitudinal area of the sheet member 31 and put the sheet member 31 between the base 33 and itself to press the sheet member 31. As the material, polycarbonate (PC) was used.

The presser member 34 is fixed on the base 33 by unshown screws by the medium of the sheet member 31. By the presser member 34, a hard-to-bond sheet member 31 formed of the ultrahigh molecular weight polyethylene (PE), the fluorine-containing resin, or the like can be stably fixed.

During an image forming operation, the transfer voltage of 500 V is applied to the base 33. This transfer voltage is transferred to the sheet member 31 to form a transfer electric field for transferring the toner image, opposing the transfer nip between the intermediary transfer belt 13 and the photosensitive drum 1*a*, from the photosensitive drum 1*a* onto the intermediary transfer belt 13.

Figure 3:
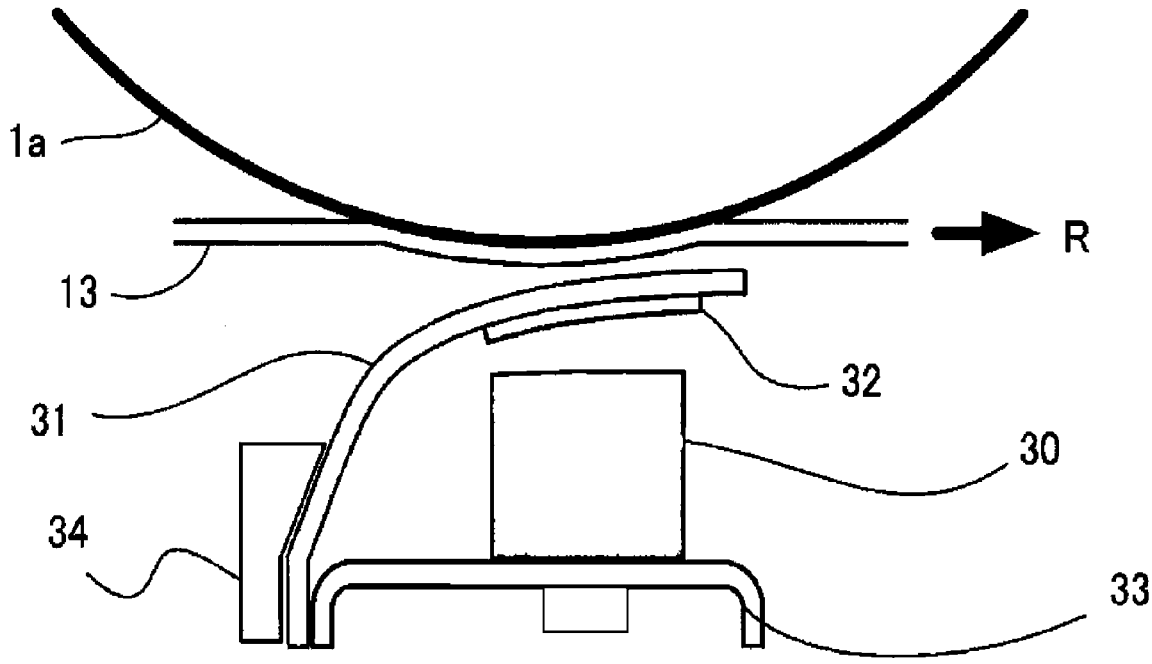
FIG. 3 is a schematic view for illustrating the sheet-like transfer device shown in FIG. 2.

Further, the sheet-like transfer device 10*a* will be described with reference to FIG. 3. In FIG. 3, the contact surface of the sheet member 31 is provided movably toward and away from the intermediary transfer belt 13. This is a constitution necessary to move the intermediary transfer belt 13 and not to move the sheet member 31. The reinforcing sheet 32 is bonded to the sheet member 31 so as not to fall off but the reinforcing sheet 32 may also be molded integrally with the sheet member 31. The sheet member 31 is configured so that its portion, as a free end on which side the reinforcing sheet 32 is provided, sandwiched between the base 33 and the presser member 34 can be bent in a vertical direction by its own flexibility.

The cushioning member 30 has the rectangular parallelopiped shape and is fixed on the base 33 in the state in which the pressure is not applied. By sandwiching the sheet member 31 between the intermediary transfer belt 13 and the cushioning member 30 which is not integrally with or not bonded to the sheet member 31, distortion of the end of the sheet member 31 can be vertically eliminated.

Further, the sheet member 31 and the cushioning member 30 are movable toward and away from each other and therefore even when the sheet member 31 moves in an in-plane direction thereof, the influence thereof on positional deviation of the cushioning member 30 can be decreased. For this reason, even when the sheet member 31 is displaced, the displacement of the transfer nip position, i.e., the position in which both of the pressure and the electric field act on the toner image can be suppressed.

Further, when the photosensitive drum 1*a* is in the form of the process cartridge provided detachably to the apparatus main assembly, exchange of consumables is simplified and usability is improved. Incidentally, an opposing member with respect to the urging means is removed by the mounting and demounting operation of the process cartridge, so that the urging force toward the sheet member 31 is temporarily decreased. When a fresh process cartridge is mounted, the position of the sheet member 32 is somewhat deviated in some cases. However, in this embodiment, even when the urging state is changed as described above, the transfer nip position is determined and stabilized by the cushioning member 30.

Here, the sheet member 31 was bonded to the base at an ambient temperature of 23° C. and the base 33 was fixed in parallel to the horizontal surface and then the surface of the sheet member 31 contacting the intermediary transfer belt 13 was scanned with a non-contact range finder (distance meter) from vertically about with respect to the longitudinal direction and the horizontal in-plane direction, so that the shape of crinkles generated on the sheet member 31 was measured.

In the case where there is no reinforcing sheet 32, the crinkles can be generated due to the temperature change on the free end side of the sheet member 31. When the number of the crinkles generated on the free end side is increased, the contact pressure causes a distribution and improper transfer occurs at a portion where the contact pressure is low or absent, so that streak-like image defect considerably decreased in image density is caused to occur. This can be remedied by increasing the spring force of the spring 36 but it is difficult to completely eliminate the image defect due to the crinkles generated at a short period.

Therefore, in this embodiment, to the sheet member 31 formed of the ultrahigh molecular weight polyethylene, the reinforcing sheet 32 having a small linear expansion coefficient at the position of the transfer nip is bonded. The reinforcing sheet 32 is configured to be bonded at least at the position of the transfer nip with respect to the rotational direction of the intermediary transfer belt 13.

By bonding the reinforcing sheet 32, even when the sheet member 31 is extended toward the free end side thereof while sliding on the intermediary transfer belt, the reinforcing sheet 32 is not elongated compared with the sheet member 31, so that the sheet member 31 is in a warped shape as a whole.

As described above, it is difficult to suppress a number of crinkles generated at the short period with respect to the longitudinal direction of the sheet member 31 by sandwiching the sheet member 31 with the cushioning member 30. However, when the sheet member 31 is placed in the warped shape at least at the transfer nip position by bonding the reinforcing sheet 32 to the sheet member 31, this warping can be subjected to urging by the cushioning member 30 for forming the transfer nip. By urging the warped portion by the cushioning member 30, it is possible to uniformize the sheet member 31 so as to follow the intermediary transfer belt 13. As a result, it is possible to prevent the streak-like image defect due to the temperature change and the long-term use.

Embodiment 1

Figure 4:
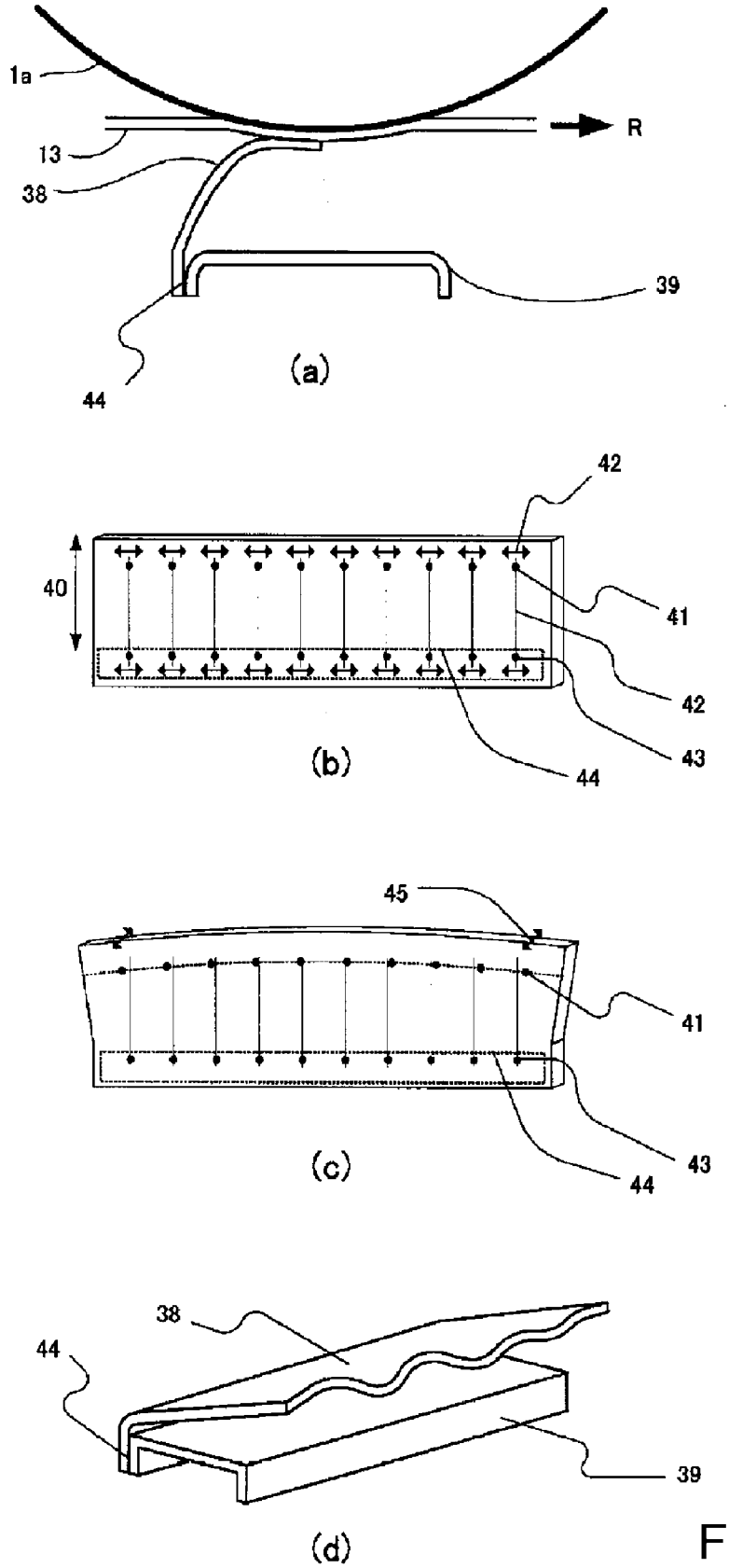
FIGS. 4(*a*) to 4(*d*) are schematic views for illustrating a sheet-like transfer device in Comparative Embodiment 1.

FIG. 4(*a*) is a schematic view for illustrating a sheet-like transfer device in Comparative Embodiment 1. A sheet member 38 was formed of the ultrahigh molecular weight polyethylene. The sheet member 38 is used, when mounted in the apparatus main assembly, in a curved state by utilizing its flexibility. That is, in Comparative Embodiment 1, the sheet member 38 does not include the reinforcing sheet. Further, the sheet-like transfer device in Comparative Embodiment 1 does not include the cushioning member.

A base 39 was formed by bending a 1 mm-thick iron plate in a U-shape. At a connecting portion 44, the sheet member 38 and the base 39 are bonded with a double-side (adhesive) tape. The transfer voltage is supplied to the sheet member 38 through the base 39 to form a transfer electric field at a portion where an end of the sheet member 38 contacts the intermediary transfer belt 13, so that the toner image on the photosensitive drum 1*a* is transferred onto the intermediary transfer belt 13.

FIG. 4(*b*) is a schematic view for illustrating a state before the sheet member 38 is mounted in the apparatus main assembly. The sheet member 38 assumes a rectangular shape in a state in which it is not bent, and is bonded to the base 39 to be fixed. Reference numerals 41 and 43 represent phantom points and are both placed on a rectilinear line 42 extending in a direction perpendicular to the base (bottom) of the sheet member 38. In the case where the sheet member 38 is bonded to the base 39 at a normal temperature (e.g., 23° C.) and the base 39 and the sheet member 38 are left standing for a long term at an ambient temperature of 30° C. (which is a temperature higher than a temperature at which the sheet member 38 is bonded to the base 39), the sheet member 38 is deformed by thermal expansion. Specifically, the sheet member 38 is liable to elongate in directions of areas 40 and 42 or the like. A schematic view for illustrating the deformation due to the temperature rise is FIG. 4(*c*). An area 44 is bonded and therefore cannot be deformed largely, so that the position of the point 43 is not changed largely from its state at 23° C.

In the case where the deformation due to the thermal expansion is assumed that it occurs only with respect to the in-plane direction of the sheet member 38, an amount of the deformation is increased with a position closer to both end portions of the sheet member 38, so that the point 41 is liable to move toward the outside of a sector-shaped sheet member 38. As a result, internal stress at the end portions is higher than that at the central portion and therefore the sheet member 38 is deformed in a direction in which the internal stress is relieved as small as possible, so that the sheet member 38 is also displaced in a sheet thickness direction in an area 45. As a result, innumerable crinkles occur at the end, so that the end of the sheet has a shape such that it is waved. FIG. 4(*d*) is a perspective view for illustrating waving of the sheet-like transfer device. A large number of crinkles occur at the free end on the side opposite from the connecting portion 44.

Evaluation of Embodiment 1 and Comparative Embodiment 1

Next, the sheet-like transfer devices 10*a* to 10*d* were mounted in the image forming apparatus and were subjected to image evaluation. The image forming apparatus was operated at a process speed of 100 mm/sec and the ambient temperature at a mounted place was 23° C. throughout a test.

The test was performed by effecting continuous image formation on 3,000 sheets per day throughout 5 days, i.e., on 15,000 sheets in total. An operating time of the image forming apparatus necessary to effect the image formation on 3,000 sheets was about 3 hours and after completion of the image formation, the operation of the image forming apparatus was paused and then was naturally cooled for about 21 hours in a stand-by state.

In order to check a print quality, a solid image of cyan toner (an image providing a maximum density for cyan) was printed on first 10 sheets (1st to 10th sheets), 201st to 210th sheets, and the last 10 sheets (2291st to 3000th sheets) every day and whether or not the streak-like improper transfer (a low image density portion) occurred was checked. As the print sheet, paper ("Xerox 4024", mfd. by Xerox Corp.) having a basis weight of 75 g/m$^2$ was used.

Evaluation Result

An evaluation result is shown in FIG. 5. In the figure, "○" mark represents no occurrence of the streak image. In the figure, "x" mark represents an occurrence of the streak image. The image forming apparatus in which the sheet-like transfer devices 10*a* to 10*d* in Embodiment 1 were mounted caused no occurrence of the streak image until 15,000 sheets.

On the other hand, the image forming apparatus in which the sheet-like transfer devices in Comparative Embodiment 1 were mounted caused the occurrence of the streak image. With respect to the first 10 sheets, the temperature of the sheet member 38 was the normal temperature and thus waving did not occur. However, the temperature of the sheet member 38 was increased up to about 30° C. by the image printing operation on 200 sheets, so that the waving occurred to result in the streak-like image defect. Further, in the printing on 3,000 sheets, the temperature of the sheet member 38 was increased up to 40° C. and was saturated, so that a degree of the occurrence of the streak-like image was deteriorated.

When the operation is continued in a state in which the streak-like image occurred, a non-uniform deformation portion is further enlarged by partial temperature rise of a high contact pressure portion at a top-point portion of the waving. In the initial stage on the fourth day, the streak-like image defect occurred even at the normal temperature. This is attributable to a phenomenon that irreversible wavy distortion occurs in the sheet member 38 by operating the sheet member 38 for a long time in a non-uniform temperature distribution and the deformation is not relieved even when the sheet member temperature is returned to the normal temperature by the natural cooling.

In Embodiment 1, the form of the deformation due to the temperature change is converted into the warping by the reinforcing sheet 32 having the lower linear expansion coefficient than that of the sheet member 31, so that it is possible to prevent application of a temperature or mechanical load and thus a stable transfer performance can be maintained even when the image forming apparatus is operated for a long term.

Incidentally, in this embodiment, the description is made such that the reinforcing sheet 32 has the lower linear expansion coefficient than that of the sheet member but the reinforcing sheet 32 is only required that the sheet member can be warped when the temperature of the sheet member is increased, so that it is also possible to use the reinforcing sheet 32 having the higher linear expansion coefficient than that of the sheet member.

That is, the reinforcing sheet may have the linear expansion coefficient different from that of the sheet member and can be appropriately selected depending on the linear expansion coefficient of the sheet member. Specifically, in the case where the linear expansion coefficient of the sheet member is $\alpha 1$ and the linear expansion coefficient of the reinforcing sheet is $\alpha 2$, it is considered that $\alpha 1$ and $\alpha 2$ may only be required to satisfy $|\alpha 2/\alpha 1-1|>0.2$.

Comparative Embodiment 2

Figure 6:
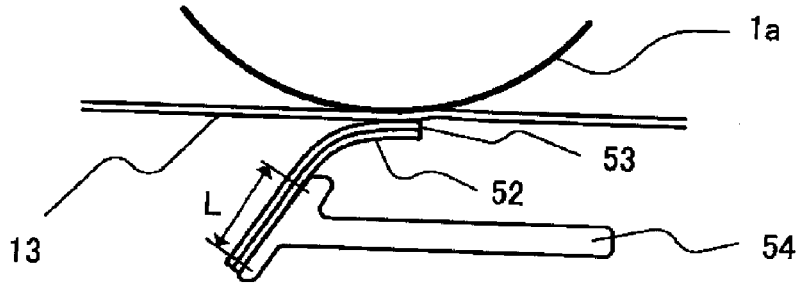
FIGS. 6(*a*) to 6(*c*) are schematic views for illustrating sheet-like transfer devices in Comparative Embodiments 2 and 3.
Figure 6:
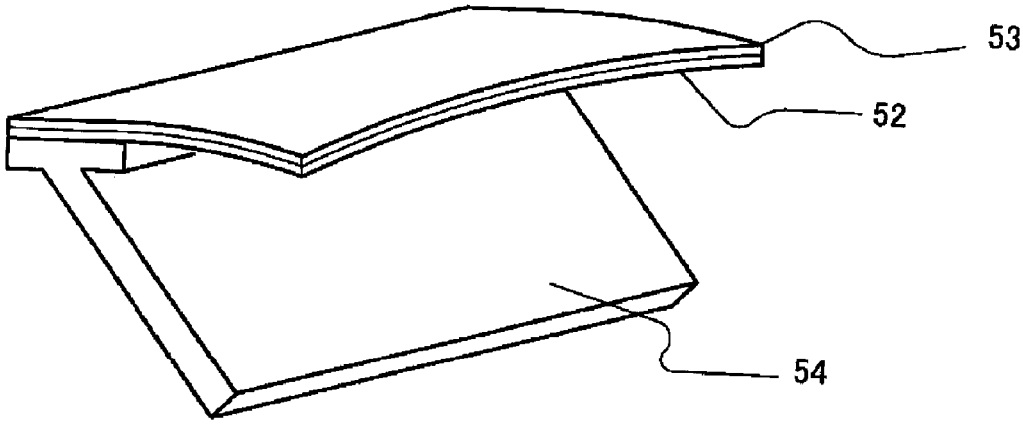
Figure 6:
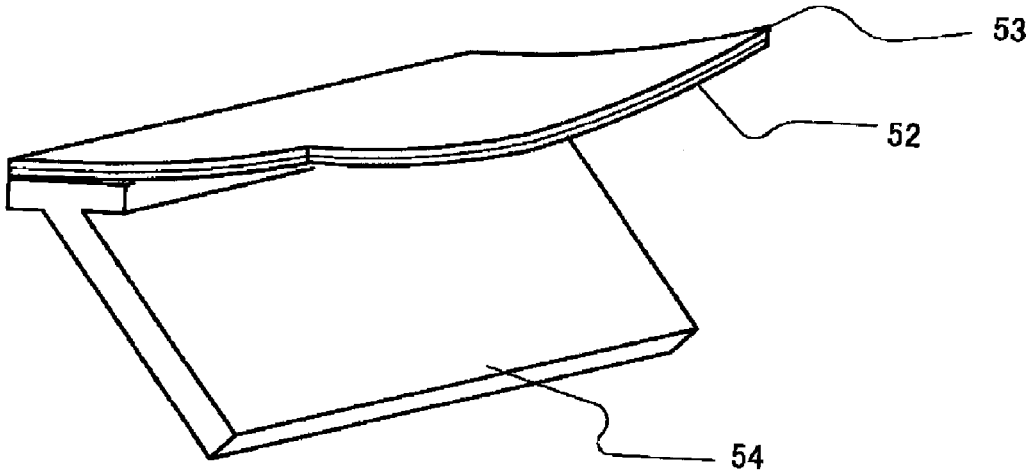

FIG. 6(*a*) is a schematic view for illustrating a constitution of a sheet-like transfer device according to Comparative Embodiment 2. A sheet member 53 is integral with a reinforcing sheet 52 and they are adhesively fixed on a transfer device supporting portion 54 in a length of L. An end of the sheet member 53 is elastically deformed to contact the intermediary transfer belt 13.

The sheet member 53 which was formed of a nylon-based resin material containing carbon black and has the linear expansion coefficient of $10\times10^{-5}$/° C. (ASTM test method D696), the electric resistance of $1\times10^{6}$ ohm to $9\times10^{7}$ ohm, and a size of 20 mm in width, 230 mm in length and 100 μm in thickness was used.

As the reinforcing sheet 52, a PET tape prepared by applying an adhesive material to one surface of a PET sheet having a width of 20 mm, a length of 230 mm and a thickness of 40 μm was used and was applied onto a back surface of the sheet member 53. The linear expansion coefficient of the PET sheet used was $6.5\times10^{-5}$/° C. (ASTM test method D696).

The sheet-like transfer device in Comparative Embodiment 2 was assembled in an ambient environment of 23° C. and was left standing in the ambient environment of 45° C. to observe a deformation state. Thereafter, the sheet-like transfer device was incorporated into the image forming apparatus and subjected to checking of the occurrence of the streak-like image defect in the ambient environment of 45° C. The occurrence of the crinkles cannot be confirmed by eye observation.

However, as shown in FIG. 6(*b*), it was confirmed that the sheet member 53 caused the warping toward the intermediary transfer belt 13.

Next, when the printing of the solid image was performed to check as to whether or not the streak-like image defect occurred, the transfer property at the central portion of the sheet member 53 was good. At the both end portions of the sheet member 53, the improper transfer occurred. This is attributable to the fact that the both end portions of the sheet member 53 created a portion, which did not contact the intermediary transfer belt 13, due to the warping of the sheet member 53 to weaken the transfer electric field to be exerted from the sheet member 53 to the toner image and thus the transfer of the toner image cannot be performed. In other words, that is because the sheet member 53 cannot be brought into contact with the intermediary transfer belt with reliability due to the absence of the cushioning member 30.

Comparative Embodiment 3

In a sheet-like transfer device in Comparative Embodiment 3, as shown in FIG. 6(*a*), the sheet member 53 and the reinforcing sheet 52 are integral with each other and are adhesively fixed on the transfer device supporting portion 54 in a length of L. An end of the sheet member 53 is elastically deformed to contact the intermediary transfer belt 13.

The sheet member 53 which was formed of a teflon (registered trademark) resin material (PTFE) containing carbon black and has the linear expansion coefficient of $4.5\times10^{-5}$/° C. (ASTM test method D696), the electric resistance of $1\times10^{5}$ ohm, and a size of 20 mm in width, 230 mm in length and 100 μm in thickness was used.

The supporting member (reinforcing sheet) 52 was prepared by applying an adhesive material to one surface of a PC (polycarbonate) sheet having a width of 20 mm, a length of 230 mm and a thickness of 40 μm and was applied onto a back surface of the sheet member 53. The linear expansion coefficient of the PC sheet used was $7\times10^{-5}$/° C. (ASTM test method D696).

The sheet-like transfer device in Comparative Embodiment 3 was assembled in an ambient environment of 23° C. and was left standing in the ambient environment of 45° C. to observe a deformation state. Thereafter, the sheet-like transfer device was incorporated into the image forming apparatus and subjected to checking of the occurrence of the streak-like image defect in the ambient environment of 45° C. The occurrence of the crinkles cannot be confirmed by eye observation. However, as shown in FIG. 6(*c*), it was confirmed that the warping toward the transfer device supporting portion 54 occurred.

Figure 7:
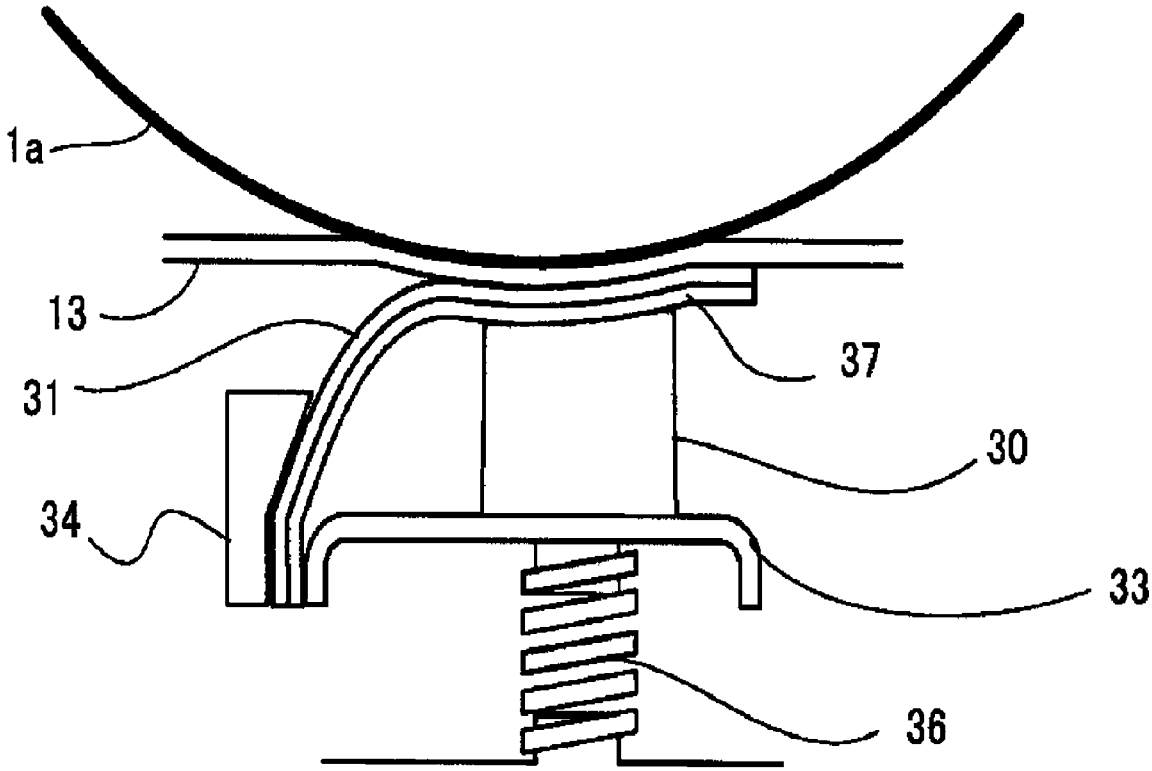
FIG. 7 is a schematic view for illustrating a sheet-like transfer device according to Embodiment 1 of the present invention.

Then, when the printing of the solid image was performed to check as to whether or not the streak-like image defect occurred, the transfer property at the both end portions of the sheet member 53 was good abut at the central portion of the sheet member 53, the improper transfer occurred. This is attributable to the fact that the both end portions of the sheet member 53 contacted the intermediary transfer belt 13 but the central portion of the sheet member 53 created a portion, which did not contact the intermediary transfer belt 13, due to the warping of the sheet member 53 to weaken the transfer electric field to be exerted from the sheet member 53 to the toner image and thus the transfer of the toner image cannot be performed. In other words, similarly as in Comparative Embodiment 2, that is because the sheet member 53 cannot be brought into contact with the intermediary transfer belt with reliability due to the absence of the cushioning member 30. Further, as shown in FIG. 7, a reinforcing sheet 37 may be bonded to the sheet member 31 through the whole area with respect to the rotational direction of the intermediary transfer belt 13. In the constitution as shown in FIG. 7, the sheet member 31 and the reinforcing sheet 37 are liable to be integrally molded.

Embodiment 2

Figure 8:
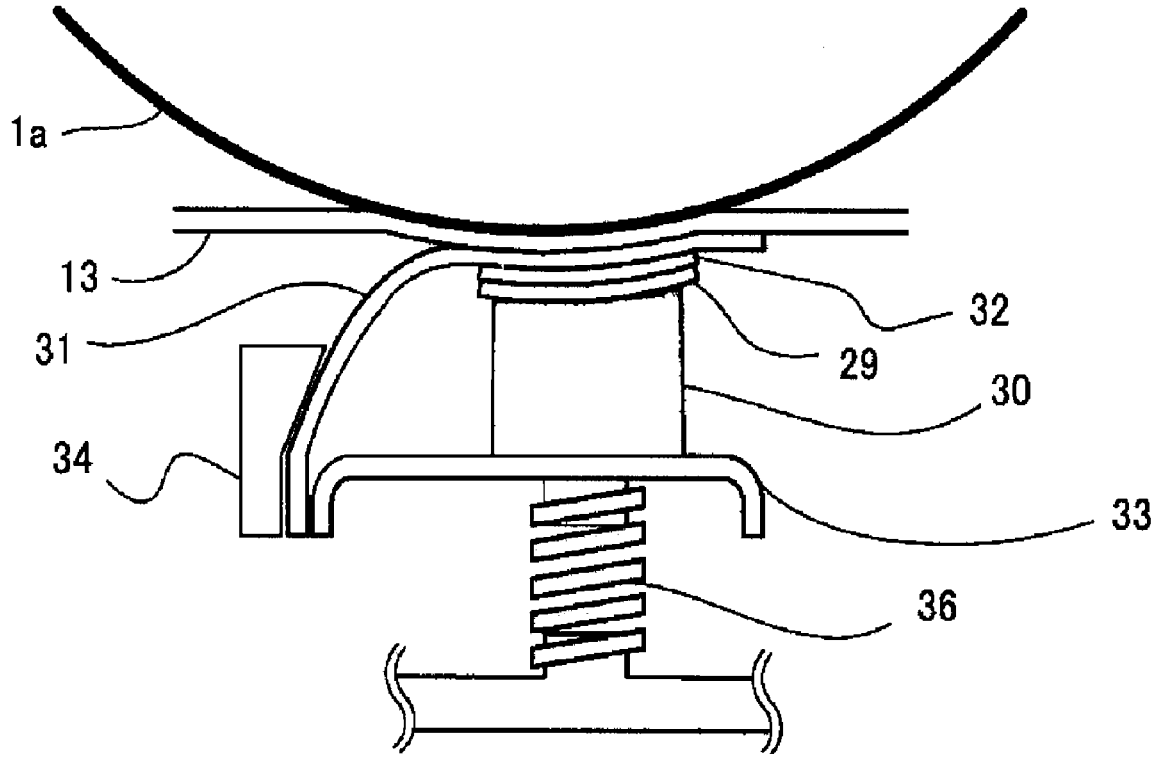
FIG. 8 is a schematic view for illustrating a sheet-like transfer device according to Embodiment 2 of the present invention.

FIG. 8 is a schematic view for illustrating a sheet-like transfer device in Embodiment 2. Constituent portions identical to those in Embodiment 1 will be described by adding the same reference numerals. A sheet member includes the sheet member 31 and the reinforcing sheet 32 on a surface opposite from a surface at which the sheet member 31 and the intermediary transfer belt 13 contact each other. Further, the sheet member 31 is provided with a warping correction sheet 29 successively and integrally formed in the same thickness as and of the same material as those of the sheet member 31. The sheet member 31, the reinforcing sheet 32, and the warping correction sheet 29 are integrally formed by bonding, welding, integral molding, or the like.

The sheet member including sheet member 31, the reinforcing sheet 32, the warping correction sheet 29 which are integral with each other is provided movably toward and away from the intermediary transfer belt 13 and the cushioning member 30 in the case where the urging force by the spring 36 is released. The presser member 34 is connected to the base 33 by an unshown screw through the sheet member.

In Embodiment 2, by applying the warping correction sheet 29 having the linear expansion coefficient equal to that of the sheet member 31 onto the back surface of the reinforcing sheet 32, a force for warping the sheet member 31 toward the opposite side is exerted, so that the warping of the sheet member 31 can be rectified. That is, the reinforcing sheet 32 is sandwiched by using the warping correction sheet 29, so that the force for warping the sheet member 31 is cancelled to compatibly realizing relief of the warping and elimination of the waving. Thus, in order to produce a warping-rectifying effect, a plurality of layers is provided and the order of linear expansion coefficient of the respective layers from a lower layer to an upper layer is controlled so as not to be monotonically decreased or monotonically increased, so that the warping can be relived and the occurrence of the waving can be suppressed.

Specifically, the sheet member 31 which was formed of the ultrahigh molecular weight polyethylene containing carbon black and has the linear expansion coefficient of $17\times10^{-5}$/° C. (ASTM test method D696), the electric resistance of $1\times10^{3}$ ohm, and a size of 20 mm in width, 230 mm in length and 100 μm in thickness was used.

As the reinforcing sheet 32, a PET tape prepared by applying an adhesive material to both surfaces of a PET sheet having a width of 7 mm, a length of 230 mm and a thickness of 70 μm was used. The linear expansion coefficient of the PET sheet used was $6.5\times10^{-5}$/° C. (ASTM test method D696). As the warping prevention sheet, a sheet having a size of 7 mm in width, 230 mm in length and 100 um in thickness was used.

The sheet-like transfer device was assembled in an ambient environment of 23° C. and was left standing in the ambient environment of 45° C. to observe a deformation state. Thereafter, the sheet-like transfer device was incorporated into the image forming apparatus and subjected to checking of the occurrence of the streak-like image defect in the ambient environment of 45° C.

In the case where the ambient temperature was largely increased, it was able to be discriminated that slight waving occurred between a portion at which the reinforcing sheet 32 was applied and a fixed portion, i.e., occurred at a portion, outside the transfer nip, at which the image was less effected. However, at the portion at which the reinforcing sheet 32 was applied, both of the waving and the warping were not observed. Then, when whether or not the streak-like image defect occurred was checked, there was no occurrence of the streak-like image.

Embodiment 3

Figure 9:
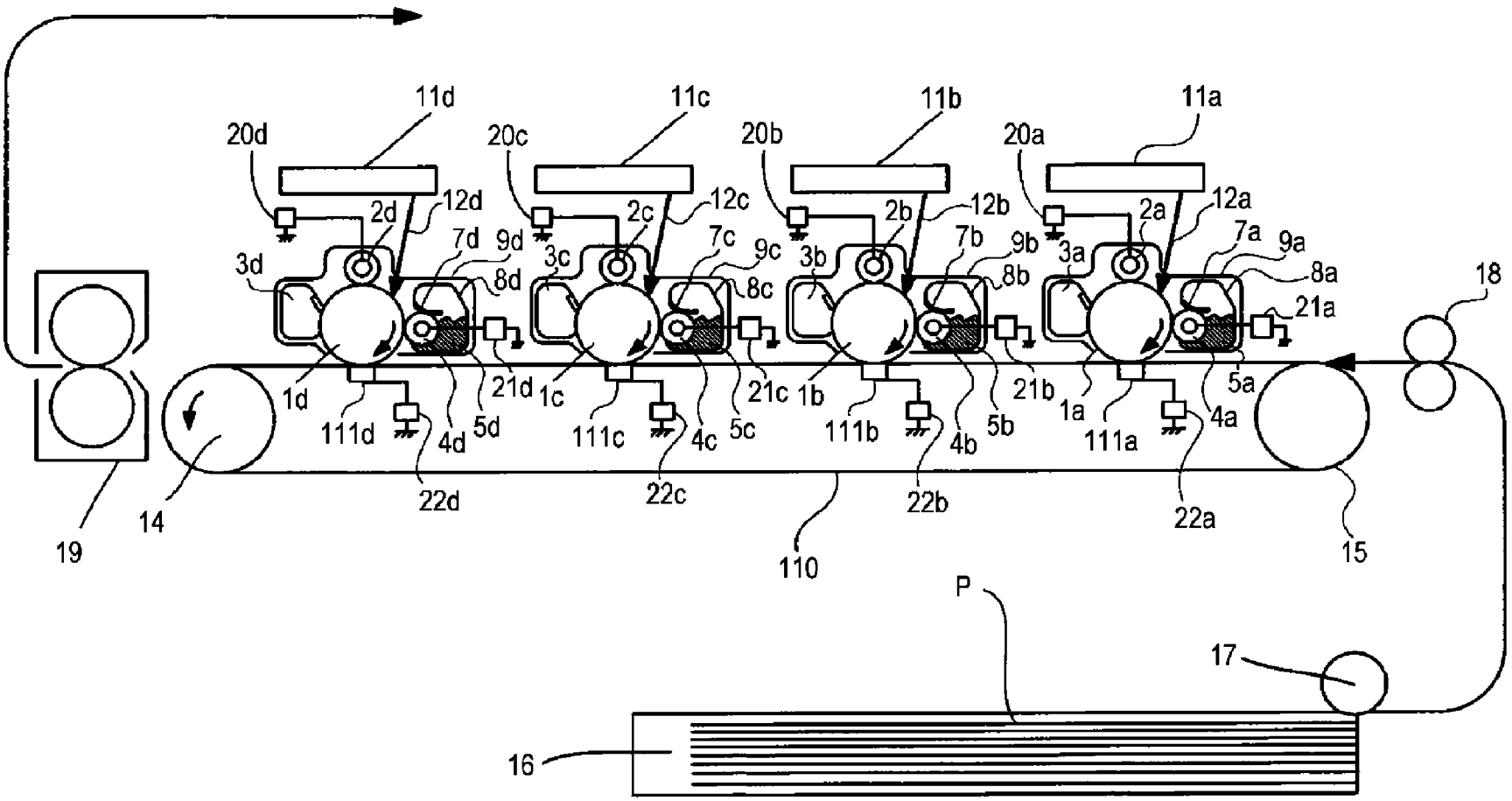
FIG. 9 is a schematic view for illustrating an image forming apparatus according to Embodiment 3 of the present invention.

FIG. 9 is a schematic view showing a general structure of the image forming apparatus according to Embodiment 3. An example in which the sheet-like transfer device in Embodiment 1 or Embodiment 2 is used in the image forming apparatus including a conveying transfer belt for carrying and conveying the transfer material is shown. In the following, with respect to Embodiment 3, constituent portions identical to those in FIG. 1 are represented by the same reference numerals or symbols and will be omitted from detailed description.

In FIG. 9, a reference numeral 110 represents the conveying transfer belt (transfer material carrying member) and this conveying transfer belt 110 is stretched by a driving roller 14 and a tension roller 15 and is rotated in a direction of an arrow to convey the transfer material P. Reference symbols 111*a* to 111*d* represent sheet-like transfer devices for transferring toner images onto the transfer material P and these sheet-like transfer devices 111*a* to 111*d* are individually disposed so as to sandwich the conveying transfer belt 110 between the photosensitive drums 1*a* to 1*d* and themselves. Further, to the sheet-like transfer devices 111*a* to 111*d*, transfer power sources 22*a* to 22*d* as a voltage supply means are individually connected.

When an image forming operation is started, the photosensitive drums 1*a* to 1*d* and the conveying transfer belt 110 start their rotations in directions indicated by arrows at predetermined process speeds. The photosensitive drums 1*a* to 1*d* are uniformly charged to a negative polarity by the charging rollers 2*a* to 2*d* and on the photosensitive drums 1*a* to 1*d*, electrostatic latent images are formed in accordance with image information by the scanning beams 12*a* to 12*d* from the exposure units 11*a* to 11*d*. Toners 5*a* to 5*d* in the developing units 8*a* to 8*d* are charged to the negative polarity by the developer application blades 7*a* to 7*d* and are applied onto the developing sleeves 4*a* to 4*d*. To the developing sleeves 4*a* to 4*d*, a voltage is supplied from developing power sources 21*a* to 21*d*. Then, when the photosensitive drums 1*a* to 1*d* are rotated and the electrostatic latent images formed on the photosensitive drums 1*a* to 1*d* reach the developing sleeves 4*a* to 4*d*, the electrostatic latent images are visualized by the negative-polarity toners. As a result, on the photosensitive drums 1*a* to 1*d*, toner images are formed.

The transfer material P stacked in a transfer material cassette 16 is picked up by a feeding roller 17 and is fed to registration rollers 18. Then, the transfer material P is conveyed by the registration rollers 18 in synchronism with the toner images on the photosensitive drums 1*a* to 1*d*.

By the sheet-like transfer devices 111*a* to 111*d*, the positive-polarity voltage is applied to the toner images on the photosensitive drums 1*a* to 1*d*, so that the transfer of the toner images onto the transfer material P is performed in synchronism with the conveyance of the transfer material P by the conveying transfer belt 110.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 111688/2009 filed May 1, 2009, which is hereby incorporated by reference.

What is claimed is:

1. An image forming apparatus comprising:

an image bearing member that bears a toner image;

a rotatable intermediary transfer member; and a transfer unit, configured and positioned to form a transfer nip between said rotatable intermediary transfer member and said image bearing member, that transfers the toner image from said image bearing member onto a surface of said rotatable intermediary transfer member, wherein said transfer unit comprises a sheet member on which said rotatable intermediary transfer member is slidable, and comprises an elastic member that urges the sheet member toward said rotatable intermediary transfer member at a position of the transfer nip, wherein the sheet member is provided with a reinforcing portion, having a linear expansion coefficient different from that of the sheet member, in an area in which the elastic member urges the sheet member, wherein the elastic member comprises a compression deformable sponge having inner pores, and wherein at an interface where the elastic member contacts the sheet member, the compression deformable sponge has fewer pores.

2. The image forming apparatus according to claim 1, wherein the sheet member has electroconductivity.

3. The image forming apparatus according to claim 1, wherein the reinforcing portion is bonded to the sheet member.

4. The image forming apparatus according to claim 1, wherein the reinforcing portion is integrally formed with the sheet member.

5. An image forming apparatus comprising:

an image bearing member that bears a toner image;

a rotatable intermediary transfer member; and a transfer unit, configured and positioned to form a transfer nip between said rotatable intermediary transfer member and said image bearing member, that transfers the toner image from said image bearing member onto a surface of said rotatable intermediary transfer member, wherein said transfer unit comprises a sheet member on which said rotatable intermediary transfer member is slidable, and comprises an elastic member that urges the sheet member toward said rotatable intermediary transfer member at a position of the transfer nip, wherein the sheet member is provided with a reinforcing portion, having a linear expansion coefficient different from that of the sheet member, in an area in which the elastic member urges the sheet member, and wherein the reinforcing portion includes a correction portion having a linear expansion coefficient equal to that of the sheet member in an area in which the reinforcing portion is urged toward said rotatable intermediary transfer member by the elastic member.

6. An image forming apparatus comprising:

an image bearing member that bears a toner image;

a rotatable transfer material carrying member that carries and conveys a transfer material; and a transfer unit, configured and positioned to form a transfer nip between said rotatable transfer material carrying member and said image bearing member, that transfers the toner image from said image bearing member onto a surface of the transfer material conveyed by said rotatable transfer material carrying member, wherein said transfer unit comprises a sheet member on which said rotatable transfer material carrying member is slidable, and comprises an elastic member that urges the sheet member toward said rotatable transfer material carrying member at a position of the transfer nip, wherein the sheet member is provided with a reinforcing portion, having a linear expansion coefficient different from that of the sheet member, in an area in which the elastic member urges the sheet member, wherein the elastic member comprises a compression deformable sponge having inner pores, and wherein at an interface where the elastic member contacts the sheet member, the compression deformable sponge has fewer pores.

7. The image forming apparatus according to claim 6, wherein the sheet member has electroconductivity.

8. The image forming apparatus according to claim 6, wherein the reinforcing portion is bonded to the sheet member.

9. The image forming apparatus according to claim 6, wherein the reinforcing portion is integrally formed with the sheet member.

10. An image forming apparatus comprising:

an image bearing member that bears a toner image, a rotatable transfer material carrying member that carries and conveys a transfer material; and a transfer unit, configured and positioned to form a transfer nip between said rotatable transfer material carrying member and said image bearing member, that transfers the toner image from said image bearing member onto a surface of the transfer material conveyed by said rotatable transfer material carrying member, wherein said transfer unit comprises a sheet member on which said rotatable transfer material carrying member is slidable, and comprises an elastic member that urges the sheet member toward said rotatable transfer material carrying member at a position of the transfer nip, wherein the sheet member is provided with a reinforcing portion, having a linear expansion coefficient different from that of the sheet member, in an area in which the elastic member urges the sheet member, and wherein the reinforcing portion includes a correction portion having a linear expansion coefficient equal to that of the sheet member in an area in which the reinforcing portion is urged toward said rotatable transfer material carrying member by the elastic member.

* * * * *